US005383478A

United States Patent [19]

Rose et al.

[11] Patent Number: 5,383,478

[45] Date of Patent: Jan. 24, 1995

[54] LOW TAR AND LOW NICOTINE CIGARETTE ADAPTED TO PROVIDE ENHANCED SMOKING SATISFACTION

[75] Inventors: Jed E. Rose; Frederique M. Behm, both of Durham, N.C.

[73] Assignee: Duke University, Durham, N.C.

[21] Appl. No.: 3,569

[22] Filed: Jan. 12, 1993

[51] Int. Cl.[6] ..... A24C 1/18

[52] U.S. Cl. ..... 131/274; 131/270; 131/275; 131/276; 131/335

[58] Field of Search ..... 131/270, 273, 347, 352, 131/359, 275, 276, 335, 331

[56] References Cited

U.S. PATENT DOCUMENTS

| | | | |
|---|---|---|---|
| 4,284,089 | 8/1991 | Ray | 131/270 |
| 4,715,387 | 12/1987 | Rose | 131/270 |
| 4,846,199 | 7/1989 | Rose | 131/329 |
| 4,887,620 | 12/1989 | Summers | 131/352 |
| 4,920,989 | 5/1990 | Rose et al. | 131/270 |
| 4,945,928 | 8/1990 | Rose | 131/270 |
| 4,953,572 | 9/1990 | Rose et al. | 131/270 |
| 5,016,652 | 5/1991 | Rose et al. | 131/270 |

OTHER PUBLICATIONS

Broucho constructor response to whaled capsaicin in Human's. by Fuller et al. American Physiological Society. pp. 1080–1084 Nov. 1984.

*Tobacco Flavoring For Smoking Products,* by Leffingwell et al. Title page pp. 7, 8, 10, 11, 23 and 58. R. J. Reynolds Tobacco Co. 1972 Aug. 1972.

J. Leffingwell et al., *Tobacco Flavoring for Smoking Products* (1972) (R. J. Reynolds Tobacco Co., Winston-Salem, NC.).

Jed E. Rose et al., "Sensory Blockade of Smoking Satisfaction", *Pharmacology Biochemistry and Behavior,* 23 (1985) pp. 289–293.

Jed E. Rose and Carol S. Hickman, "Citric Acid Aerosol as a Potential Smoking Cessation Aid", *CHEST,* 92 (Dec. 1987) pp. 1005–1008.

Jed E. Rose, "The Rose of Upper Airway Stimulation in Smoking", *Nicotine Replacement: A Critical Evaluation* (1988) (Alan R. Liss, Inc.), pp. 95–106.

Edward D. Levin et al., "Development of a citric Acid Aerosol as a smoking cessation aid", *Drug and Alcohol Dependence,* 25 (1990) pp. 273–279.

Edward D. Levin et al., "The use of flavor in cigarette substitutes", *Drug and Alcohol Dependence,* 26 (1990) pp. 155–160.

Frederique M. Behm, et al., "Low-Nicotine Regenerated Smoke Aerosol Reduces Desire for Cigarettes", *Journal of Substance Abuse,* 2 (1990) pp. 237–247.

Jed E. Rose and Edward D. Levin, "Inter-relationships between conditioned and primary reinforcement in the maintenance of cigarette smoking", *British Journal of Addiciton,* 86 (1991) pp. 605–609.

*Primary Examiner*—William H. Grieb

*Attorney, Agent, or Firm*—Richard E. Jenkins

[57] ABSTRACT

A low tar cigarette product and method of use which enhances the sensory impact of low tar and low nicotine cigarettes in order to increase their acceptability and reduce the likelihood that smokers will exhibit compensatory smoking during use thereof. The novel cigarette utilizes an irritant selected from the group consisting of one or more constituents from black and/or red pepper, capsaicinoids, and mixtures of the foregoing in the tobacco thereof. Subsequent to igniting the tobacco and inhaling from the cigarette, the irritant creates respiratory tract sensations in a user substantively similar to those obtained by inhalation of tobacco smoke from a conventional cigarette.

10 Claims, 2 Drawing Sheets

LOW TAR AND LOW NICOTINE CIGARETTE ADAPTED TO PROVIDE ENHANCED SMOKING SATISFACTION

GOVERNMENT RIGHTS

This invention was made with U.S. Government support by virtue of the material support of the Veterans Administration. The government has certain rights in the invention.

TECHNICAL FIELD

The present invention relates in general to low tar and low nicotine cigarettes, and more particularly to an improved low tar and low nicotine cigarette which serves to increase the acceptability of low tar and low nicotine cigarettes so as to reduce the harmful effects of cigarette smoking.

RELATED ART

The most popular brands of conventional cigarettes deliver about 16 milligrams of tar, 1 milligram of nicotine and 16 milligrams of carbon monoxide per cigarette. These potentially harmful substances are believed to account for a considerable number of diseases which have been causally connected to cigarette smoking. This connection between cigarette smoking and health hazards is, of course, well known to the general population today due to efforts by government entities (such as the Office on Smoking and Health of the U.S. Department of Health and Human Services) to educate the general public as to the risks involved in habitual smoking of cigarettes.

In recognition of this issue, cigarette manufacturing companies began making and selling a variety of brands of "low tar" cigarettes which deliver relatively small amounts of tar, nicotine and carbon monoxide which could potentially significantly reduce the health hazards associated with smoking cigarettes. Unfortunately, it has been discovered that only a small proportion of the total smoking population (e.g., less than 25%) has substituted low tar cigarettes (e.g., cigarettes that deliver less than 10 milligrams of tar) for conventional and more hazardous cigarettes. Also of note, only about 2.0–3.0% of total cigarette sales are accounted for by very low tar cigarettes (e.g., cigarettes that deliver less than 3 milligrams of tar). Moreover, even among the cigarette smokers who have substituted low tar cigarettes for conventional cigarettes, it has been discovered that these individuals will tend to smoke low tar cigarettes more intensively in order to extract more tar and nicotine than the nominal values listed on the pack. This, of course, defeats part of the objective of the low tar cigarettes.

Applicants have previously discovered that part of the reason smokers dislike low tar and low nicotine cigarettes is the absence of the usual sensory cues perceived in the respiratory tract when a puff of smoke is inhaled from a conventional cigarette. During the smoking process, these respiratory tract sensations, along with the taste and aroma of the smoke and the act of puffing provide a considerable portion of the satisfaction a smoker experiences. It is believed that these sensory cues may help to maintain a dependency on cigarettes. Moreover, the cumulative irritation in the respiratory tract by conventional cigarettes tends to limit smoke intake, but with low tar and low nicotine cigarettes compensatory smoking increases occur due to the lack of the respiratory tract sensations.

In experiments in which applicants temporarily blocked the respiratory tract sensations of smoking by having test subjects inhale a lidocaine aerosol, it was found that the satisfaction associated with inhalation of a controlled dose of nicotine was significantly reduced. Thus, applicants have attempted heretofore to develop smoking reduction and smoking cessation aids which deliver some of the sensory and habit aspects of smoking.

One such technique that has been developed is a method of delivering fine particles of citric acid to simulate the respiratory tract sensations of smoking (see U.S. Pat. No. 4,715,387). Applicants have found this process to be helpful in relieving smokers' craving for cigarettes. Until the improved low tar cigarette invention described hereinbelow was developed, the citric acid invention has been one of only several known methods for attempting to simulate respiratory tract sensations of smoking without using nicotine or other drugs that entail extensive FDA regulation and which may even be addictive. Unfortunately, citric acid and related compounds are not sufficiently volatile to be added to the tobacco in a low tar and low nicotine cigarette and to be delivered to the smoker in significant amounts.

Some other methods for providing the sensory components of smoking which do involve the use of nicotine include a low-dose nicotine aerosol (see U.S. Pat. No. 4,953,572), a regenerated smoke aerosol (see U.S. Pat. No. 4,945,928), and a nicotine vapor inhaler (see U.S. Pat. No. 4,284,089). These methods while all showing some promise, suffer from certain shortcomings. First, nicotine when delivered apart from cigarettes is classified as a drug and is subject to extensive FDA regulation. Second, nicotine has an aversive bitter, burning taste which limits the acceptability of products such as nicotine chewing gum. Even habitual smokers usually do not like the actual taste of nicotine when "unmasked" by being disassociated from other flavorful smoke components. While the regenerated smoke method noted above does not suffer from these particular drawbacks since pure nicotine is not used and many of the desired taste components of tar are still present, the apparatus and technology required for this process are complex and expensive and are difficult to incorporate into a conventional cigarette.

Given the above history of efforts to minimize the health hazards associated with cigarette smoking, applicant has now overcome many of the problems of previous smoking reduction and/or cessation aids described above with the improved low tar and low nicotine cigarette invention described hereinbelow.

DISCLOSURE OF THE INVENTION

In accordance with the present invention, a novel low tar and low nicotine cigarette is provided which will increase the desirability to the smoker of a low tar and low nicotine cigarette and discourage compensatory increases in smoking. The cigarette acts to improve the desirability of smoking a low tar and low nicotine cigarette by simulating respiratory tract sensations in a user substantively similar to those obtained by inhalation of tobacco smoke from a conventional cigarette and comprises tobacco having therein an irritant selected from the group consisting of one or more constituents from black and/or red pepper, capsaicinoids, and mixtures of the foregoing.

The smoker ignites the cigarette tobacco and then inhales from the cigarette so as to introduce at least a portion of the irritant into the respiratory tract. In this fashion, the respiratory tract sensations created by the irritant simulates those created by tobacco smoke from a conventional cigarette so as to increase the satisfaction provided by the low tar and low nicotine cigarette. The invention is contemplated to include the novel low tar cigarette product and the method of use of the novel cigarette product.

It is therefore one of the primary objects of the present invention to provide a low tar and low nicotine cigarette which includes an irritant selected from the group consisting of one or more constituents from black and/or red pepper, capsaicinoids, and mixtures of the foregoing in the tobacco thereof to simulate the sensations in the respiratory tract normally caused by tobacco smoke so as to increase the satisfaction provided by the cigarette to the smoker.

It is another object of the present invention to provide a novel low tar and low nicotine cigarette which provides the sensory cues usually perceived in the respiratory tract when inhaling a puff of smoke from a conventional cigarette so as to increase the desirability of smoking the low tar and low nicotine cigarette as well as to provide an increased sensory impact so as to discourage compensatory increases in smoking.

It is still another object of the present invention to provide a novel low tar and low nicotine cigarette which overcomes the traditional weak taste and dissatisfying feeling associated with conventional low tar and low nicotine cigarettes so as to facilitate substitution of the less hazardous cigarette for the more hazardous conventional cigarettes.

Some of the objects of the invention having been stated hereinabove, other objects will become evident as the description proceeds hereinbelow.

BEST MODE FOR CARRYING OUT THE INVENTION

Figure 1:
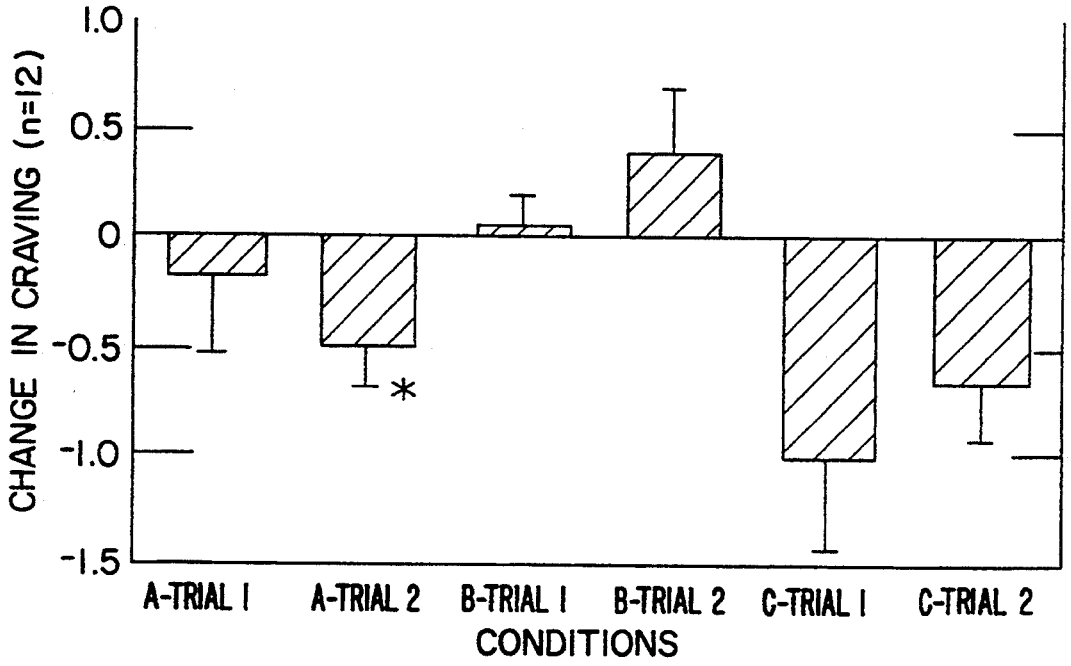
FIG. 1 is a graph of test results showing the reported change in craving for tobacco smoke after puffing for a predetermined period of time on the improved low tar and low nicotine cigarette of the present invention as compared to (1) a conventional low tar cigarette and (2) a conventional relatively high tar cigarette.

The present invention provides an unexpectedly and surprisingly effective low tar and low nicotine cigarette product for increasing the desirability of low tar and low nicotine cigarettes and discouraging compensatory increases in smoking by simulating respiratory tract sensations in the smoker substantively similar to those obtained by inhalation of tobacco smoke from a conventional relatively high tar cigarette.

The present invention comprises a product and method of use for enhancing the sensory impact of low tar and low nicotine cigarettes in order to increase their acceptability and to reduce the likelihood that smokers will exhibit compensatory smoking behavior when using this type of cigarette. In a preferred embodiment of the invention, selected tobacco for use in the manufacture of a low tar and low nicotine cigarette has an irritant applied thereto during the manufacturing process which is selected from the group consisting of one or more constituents from black and/or red pepper, capsaicinoids, and mixtures of the foregoing. Most preferably, the irritant comprises one or more constituents from either black and/or red pepper such as capsaicin, piperine and/or phellandrene. Thus, when the low tar cigarette manufactured with the irritant provided in the tobacco thereof is smoked, each puff from the cigarette will deliver, along with the usual smoke components, small amounts of the aforementioned one or more irritants which serve to provide relatively strong sensory cues resembling the feeling of inhaling high nicotine smoke.

In one sense, the objective of the present invention is somewhat similar to the regenerated smoke aerosol invention described in the related art section hereinabove. However, applicants' subject invention has a significant advantage over the regenerated smoke method in that it does not entail a significantly different cigarette manufacturing technology or apparatus for smoking. The new cigarette can be easily manufactured using existing cigarette manufacturing technology by applying the selected irritant to the tobacco in a manner which would be well known to one skilled in the cigarette manufacturing art.

Also, applicant notes that the new product and method provide a more appealing sensory experience for the smoker than the citric acid aerosol method discussed in the related art section above because the irritant component does not have the sour taste of citric acid or related types of acids. The smoke components of the present invention deliver characteristic smoke taste and aroma along with the irritant components when the improved low tar and low nicotine cigarette of the invention is smoked.

Applicants have observed that capsaicin, and possibly other irritants selected from the group consisting of one or more constituents from black and/or red pepper, capsaicinoids and mixtures of the foregoing, act to stimulate the same nerve endings (vagal C-fibers) in the respiratory tract that are stimulated by nicotine. Applicants' research has indicated that the nicotine-sensitive sensory nerve endings in the respiratory tract act to mediate smoking satisfaction and to reduce the craving for a cigarette. Thus, when using the improved cigarette product of the present invention, applicants believes that smokers are not only likely to find the low tar cigarette more acceptable but that smokers' actual intake of tar and nicotine is likely to remain very close to the nominal values printed on the cigarette pack for the product since the smokers will not take larger puffs or smoke more intensely as is typically experienced with conventional low tar and low nicotine cigarette smoking.

Very significantly, applicants further believe that smokers who substitute the novel cigarette product of the invention for traditional high tar cigarette brands will experience a proportional decrease in mortality and morbidity which results from long-term smoking of conventional higher tar and higher nicotine cigarettes.

In order to provide a suitable irritant as described above to the tobacco during the manufacture of the low tar cigarette, the irritant comprising one or more constituents of black and/or red pepper (such as capsaicin, piperine and phellandrene) or the capsaicinoid most suitably should be dissolved in a suitable medium such as a solvent. Although the solvent and the relative proportion thereof is to some extent a matter of choice, applicant prefers the use of ethanol with the irritant dissolved therein at between about 0.005 to 10.0 weight percent (capsaicin, for example, being dissolved therein at between about 0.005 to 0.05 weight percent).

The solvent most suitably would then be applied to the tobacco by spraying, soaking or other conventional manufacturing application during the manufacture thereof into low tar and low nicotine cigarettes. Also, applicant contemplates that the solvent having the irritant dissolved therein could be applied to the cigarette tobacco subsequent to the manufacture of the cigarette and prior to the packaging thereof for sale to the consumer in a suitable fashion which would be apparent to one skilled in the cigarette manufacturing art.

Most suitably, subsequent to application of the irritant to the cigarette tobacco the tobacco should comprise about 0.10 to 100 milligrams of irritant per gram of tobacco. More specifically, if the irritant is capsaicin, the cigarette tobacco should comprise about 0.10 to 0.50 milligrams of capsaicin per gram of tobacco subsequent to application of the irritant.

Although the product and method of use of the instant invention primarily contemplate the use of irritants comprising constituents of black and/or red pepper (for example, capsaicin, piperine and phellandrene), applicants further believe that capsaicinoids (which are well known to those skilled in the art) possess significant efficacy when used as the irritant in the instant invention and are thus contemplated as being within the scope of the invention. As will be appreciated by one skilled in the art, both naturally occurring capsaicinoids and synthetic capsaicinoids having the same pharmacological effect as naturally occurring capsaicinoids may be used in the practice of the present invention.

LABORATORY TEST

In order to test the efficacy of capsaicin in amplifying the satisfaction obtained from a low tar and low nicotine cigarette, an experiment was conducted with 12 healthy male volunteer smokers. The subjects smoked an average of 30.6 cigarettes per day (s.d.=15.6) having a mean nicotine delivery of 1.0 milligram (s.d.=0.093). The subjects' mean age was 32.9 years (s.d.=8.4).

Each subject participated in a three (3)-hour session which presented three (3) types of cigarettes. One cigarette type was a low tar and low nicotine NOW brand cigarette manufactured by R. J. Reynolds Tobacco Company (nicotine delivery of 0.1 milligram by FTC analysis), the tobacco of which had been previously soaked in 2.0 grams of a solution of 0.01% capsaicin in ethanol, allowed to dry overnight, and then repacked into the cigarette paper. The control cigarettes (also NOW brand) were soaked in ethanol without any capsaicin dissolved therein. A third type of cigarette was a WINSTON brand manufactured by R. J. Reynolds Tobacco Company which was high in nicotine delivery (1.0 milligram). Two cigarettes of each type were smoked in succession by the subjects, with a 30- minute interval between cigarettes. The order of cigarette type was counterbalanced across the subjects.

Figure 2:
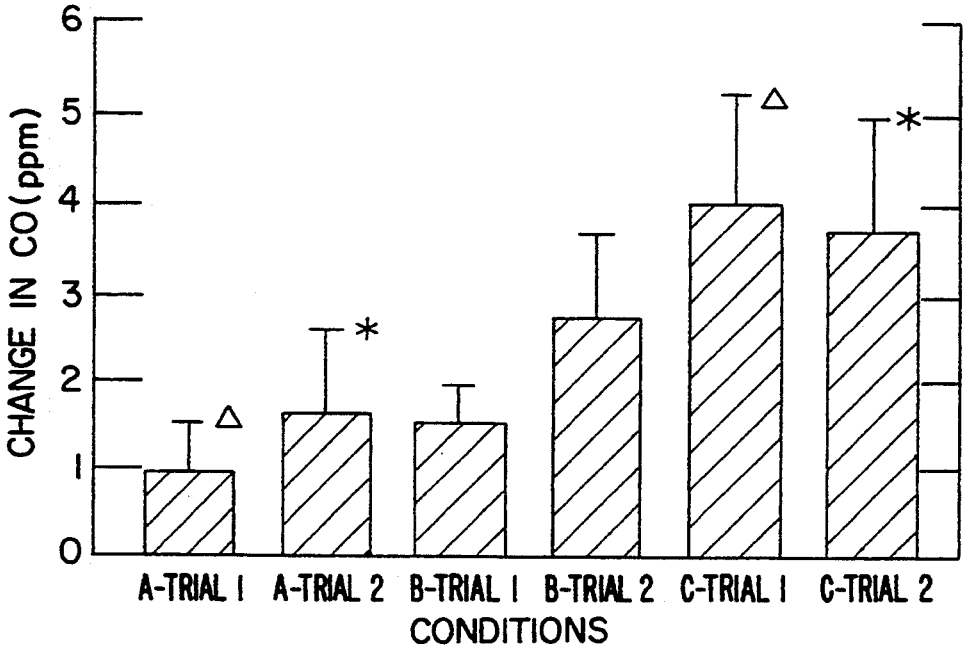
FIG. 2 is a graph of test results showing the carbon monoxide boost in parts per million (PPM) after puffing for a predetermined time on the improved low tar and low nicotine cigarette of the invention as compared to (1) a conventional low tar cigarette and (2) a conventional relatively high tar cigarette.
Figure 3:
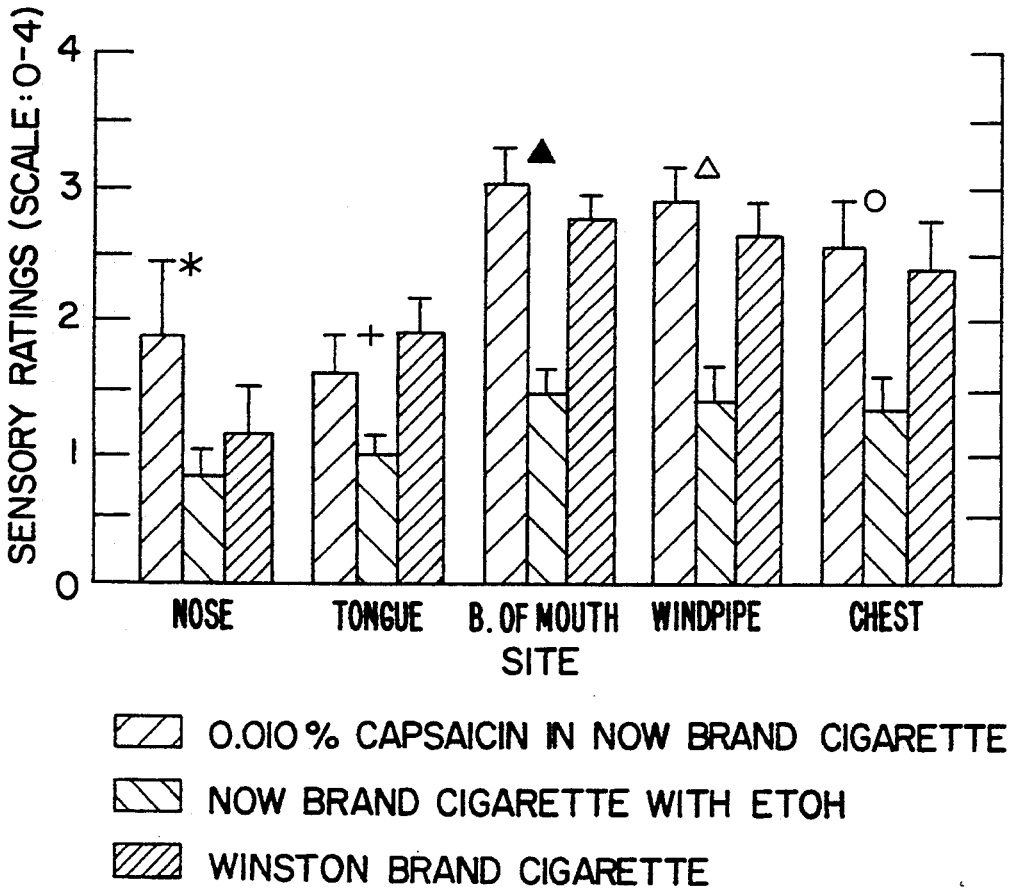
FIG. 3 is a graph of test results showing subjective ratings of respiratory tract sensations after puffing for a predetermined time on the three cigarette products described in FIGS. 1 and 2 above.

With reference now to FIGS. 1-3, the subjects rated their craving for cigarettes before and after each cigarette, using a rating scale ranging from 1 ("very definitely not") to 7 ("very definitely"). The conditions were as follows: A=0.10% capsaicin in NOW brand cigarette; B=NOW brand cigarette; and C=WINSTON brand cigarette; wherein, *A-Trial 2 vs. B-Trial 2, $p<0.04$. As shown in FIG. 1, there was a trend for the capsaicin-enhanced low tar cigarettes to reduce craving more than the control low tar cigarettes. The difference between the two types of cigarettes was statistically significant for the second cigarette of each type, by which time the subjects were familiar with the cigarettes.

Applicants also measured the subjects' expired air carbon monoxide levels before and after each cigarette, which was indicative of the degree of smoke inhalation in each condition. The conditions were as follows: A=0.010% capsaicin in NOW brand cigarette; B=NOW brand cigarette; and C=WINSTON brand cigarette; wherein Δ A-Trial 1 vs. C-Trial 1, $p<0.005$; and * A-Trial 2 vs. C-Trial 2, $p=0.07$. As shown in FIG. 2, the subjects inhaled less from the capsaicin-enhanced low tar cigarettes (condition A) than from the control low tar cigarettes (condition B). Thus, the subjects obtained a greater degree of reduction in craving from the capsaicin-enhanced cigarette with a smaller intake of hazardous smoke constituents. Of course, intake of carbon monoxide and other smoke constituents was greatest from the high tar and nicotine cigarette. Finally, the sites in FIG. 3 are as follows: [ ] 0.010% capsaicin in NOW brand cigarette; [ ] NOW brand cigarette with ETOH; and [ ] WINSTON brand cigarette; wherein, * NOSE: 0.0010% capsaicin in NOW cigarette vs. NOW cigarette with ETOH, $p<0.04$; + TONGUE: 0.010% capsaicin in NOW cigarette vs. NOW cigarette with ETOH, $p<0.02$; Δ B of MOUTH: 0.010% capsaicin in NOW cigarette vs. NOW cigarette with ETOH, $p<0.0007$; Δ WINDPIPE: 0.010% capsaicin in NOW cigarette vs. NOW cigarette with ETOH, $p<0.0005$; and o CHEST: 0.010% capsaicin in NOW cigarette vs. NOW cigarette with ETOH, $p<0.00005$. FIG. 3 illustrates that subjective ratings of respiratory tract sensations also showed that the capsaicin-enhanced low tar cigarettes provided a more intense sensation than did the control low tar cigarettes (NOW brand) and were comparable to the high tar cigarettes (WINSTON brand).

These results support applicants' discovery that irritants, particularly constituents from black and/or red pepper, are useful when incorporated into a low tar and low nicotine cigarette in providing greater smoking satisfaction and reducing the compensatory increases in smoking which can occur with the use of the aforementioned low tar and low nicotine cigarettes.

It will be understood that various details of the invention may be changed without departing from the scope of the invention. Furthermore, the foregoing description is for the purpose of illustration only, and not for the purpose of limitation—the invention being defined by the claims.

What is claimed is:

1. A method for improving the desirability of smoking a low tar and low nicotine cigarette by simulating respiratory tract sensations in a user substantively similar to those obtained by inhalation of tobacco smoke from a conventional cigarette, said method comprising:

(a) providing an irritant selected from the group consisting of one or more constituents from black and/or red pepper, capsaicinoids, and mixtures of the foregoing in the tobacco of a low tar and low nicotine cigarette in an amount of about 0.10 to 100 milligrams of irritant per gram of tobacco;

(b) igniting said cigarette tobacco; and (c) inhaling from said cigarette so as to introduce at least a portion of said irritant to the respiratory tract of the user, and reduce craving for a cigarette and discourage compensatory increases in smoking by the user;

whereby the respiratory tract sensations created by said irritant simulate those created by tobacco smoke from a conventional cigarette so as to increase the satisfaction provided by said cigarette.

2. A method according to claim 1 wherein said one or more constituents from black and/or red pepper is selected from the group consisting of capsaicin, piperine, phellandrene and mixtures thereof.

3. A method according to claim 1 wherein said irritant is provided in said tobacco by applying a solution comprising said irritant thereto during manufacture of said low tar and low nicotine cigarette.

4. A method for improving the desirability of smoking a low tar and low nicotine cigarette by simulating respiratory tract sensations in a user substantively similar to those obtained by inhalation of tobacco smoke from a conventional cigarette, said method comprising:

(a) providing an irritant comprising capsaicin in the tobacco of a low tar and low nicotine cigarette in an amount of about 0.10 to 100 milligrams of irritant per gram of tobacco;

(b) igniting said cigarette tobacco; and (c) inhaling from said cigarette so as to introduce at least a portion of said irritant to the respiratory tract of the user, and reduce craving for a cigarette and discourage compensatory increase in smoking by the user;

whereby the respiratory tract sensations created by said irritant simulate those created by tobacco smoke from a conventional cigarette so as to increase the satisfaction provided by said cigarette.

5. A method according to claim 4 wherein said capsaicin is provided in said tobacco by applying a solution comprising said capsaicin thereto during manufacture of said low tar and low nicotine cigarette

6. A low tar and low nicotine cigarette characterized in that it provides for improved desirability of smoking a low tar and nicotine cigarette and reduced for craving for a cigarette and it discourages compensatory increases in smoking by simulating respiratory tract sensations in a user similar to those obtained by inhalation of smoke from a conventional cigarette, said cigarette comprising tobacco having about 0.1 to 100 milligrams of an irritant therein selected from the group consisting of one or more constituents from black and/or red pepper, capsaicinoids, and mixtures of the foregoing.

7. A low tar and low nicotine cigarette according to claim 6 wherein said one or more constituents from black and/or red pepper is selected from the group consisting of capsaicin, piperine, phellandrene and mixtures thereof.

8. A low tar and low nicotine cigarette according to claim 6 wherein said irritant is provided in said tobacco by applying a solution comprising said irritant thereto during manufacture of said low tar and low nicotine cigarette.

9. A low tar and low nicotine cigarette characterized in that it provides for improved desirability of smoking a low tar and low nicotine cigarette and reduced craving for a cigarette and it discourages compensatory increases in smoking by simulating respiratory tract sensations in a user similar to those obtained by inhalation of smoke from a conventional cigarette, said cigarette comprising tobacco having about 0.1 to 100 milligrams of an irritant therein comprising capsaicin.

10. A low tar and low nicotine cigarette according to claim 9 wherein said irritant is provided in said tobacco by applying a solution comprising said irritant thereto during manufacture of said low tar and low nicotine cigarette.

* * * * *